United States Patent [19]

Hoyle

[11] 4,167,347

[45] Sep. 11, 1979

[54] WRITING INSTRUMENT REMOVABLE FINGER GRIP

[76] Inventor: James E. Hoyle, 302 Orange Grove, Fillmore, Calif. 93015

[21] Appl. No.: 843,372

[22] Filed: Oct. 19, 1977

[51] Int. Cl.[2] ..... B43K 23/02

[52] U.S. Cl. ..... 401/88; 401/6; 15/427

[58] Field of Search ..... 401/88, 6–8, 401/49; 15/427; D19/35, 41, 45, 47, 48, 51

[56] References Cited

U.S. PATENT DOCUMENTS

| | | | |
|---|---|---|---|
| 249,893 | 11/1881 | Bulkeley | 401/88 |
| 447,873 | 3/1891 | Hanimann | 15/427 |
| 1,291,972 | 1/1919 | McGuigan | 401/88 |
| 2,236,194 | 3/1941 | Lorber | 401/88 |
| 2,594,955 | 4/1952 | Markowitz | 401/88 |
| 4,030,841 | 6/1977 | Balasty | 401/88 |

*Primary Examiner*—William Pieprz

*Attorney, Agent, or Firm*—Jessup & Beecher

[57] ABSTRACT

A removable finger grip adaptable to a wide variety and size of writing instruments. The finger grip is an elongate resilient body having a triangular cross-sectional shape and a cylindrical bore coaxial with the longitudinal axis. In order to accommodate a wide variety of writing instruments, the cylindrical bore has a plurality of ribs or ridges along the entire length of the bore for gripping instruments smaller in size than the diameter of the bore. The triangular shape provides three planar surfaces for gripping the device when installed on a writing instrument and also provides a thin web of material in the planar gripping surfaces between them and the cylindrical bore at the center of the planar gripping surfaces. This thin web allows the finger grip to expand for accommodating writing instruments larger than the cylindrical bore. The resilience of the finger grip allows easy removal from one writing instrument for use with another.

2 Claims, 5 Drawing Figures

WRITING INSTRUMENT REMOVABLE FINGER GRIP

BACKGROUND OF THE INVENTION

This invention relates generally to finger grips for writing instruments and more particularly to devices for promoting proper use of writing instruments.

Today, virtually every occupation or profession entails a considerable amount of writing, even where modest uncomplicated records are to be maintained. In fact, any profession, such as drafting, bookkeeping, commercial art, and the like, require much writing or drawing. Such professions require persons to spend many hours using a pencil or pen, dictating the need for proper penmanship to improve efficiency in writing as well as reading handwritten material.

The need for a comfortable, well-proportioned writing instrument, the use of which is virtually unaffected by perspiration and the like, has been long recognized. Such an instrument, it has been realized, should be extremely comfortable so that the user can grip the pencil for a considerable period of time without creating any discomfort such as "writer's cramp". Also, such instrument should be so constructed that normal perspiration of the user's hand and fingers does not impair the grip of the user so as to cause the instrument to slip or to require additional gripping force.

In addition to the need for comfortable writing instruments, the promotion of proper penmanship is now being recognized as necessary to combat deficiencies in posture as well as vision. For example, it has been found that improper use of writing instruments has caused orthopedic problems later in life, such as arm, shoulder or neck problems, due to excessive strain in these areas. Further, the improper use of writing instruments has on occasion resulted in erroneous diagnosis of visual problems, when the only difficulty was the person's inability to see what they were writing because of contorted use of the writing instrument. When an improper grip is used with a writing instrument, penmanship necessarily must suffer, which can increase communication problems. Therefore, there is a need for a device which promotes proper gripping of a writing instrument to alleviate the aforesaid problems in addition to improving proper penmanship. Improvements in penmanship also promote efficiency in work output and in communications in general.

In view of the foregoing shortcomings, it is an object of the present invention to provide a writing instrument finger grip which is comfortable for the user during protracted periods of time.

Another object of the present invention is to provide a writing instrument finger grip which promotes good writing habits.

Another object of the present invention is to provide a writing intrument finger grip as characterized above, having a gripping portion provided with three equiangularly disposed gripping surfaces.

Another object of the present invention is to provide a finger grip as characterized above, formed of resilient material to afford comfortable gripping surfaces.

Another object of the present invention is to provide a finger grip removably attached to a writing device to provide a comfortable grip for the user.

Another further object is to provide a finger grip as characterized above which can be adapted to various size writing instruments.

A still further object of this invention is to provide a finger grip for writing instruments as characterized above, which is simple and inexpensive to manufacture, and which is rugged and dependable in operation.

Other objects, advantages and novel features of the invention will become apparent from the following detailed description of the invention when considered in conjunction with the accompanying drawings, wherein like reference numbers identify like parts throughout.

DETAILED DESCRIPTION OF THE PREFERRED EMBODIMENT

Figure 1:
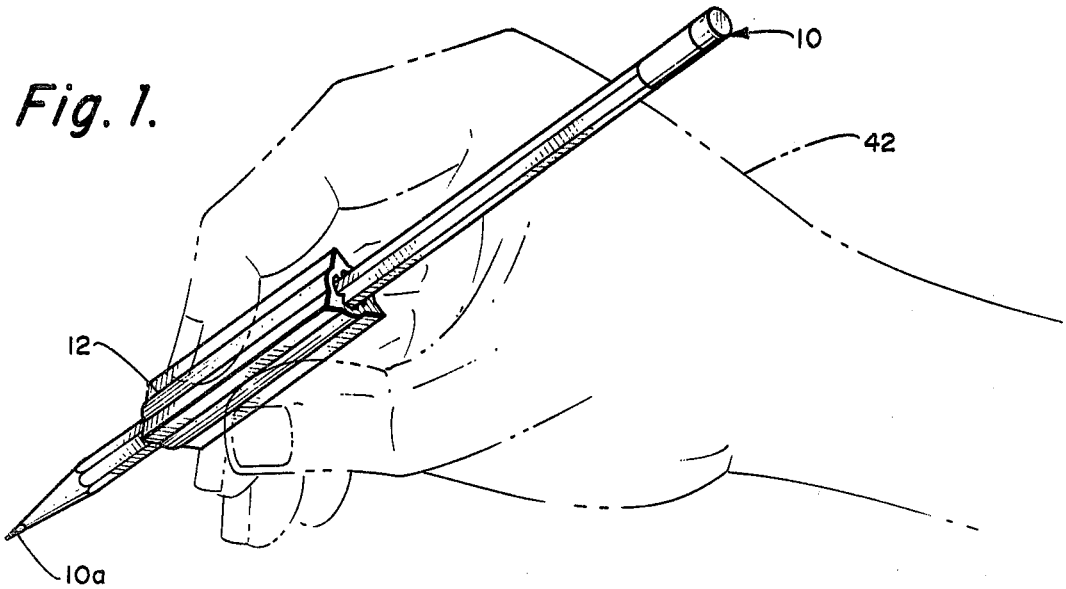
FIG. 1 is a perspective view of a finger grip according to the present invention illustrating its use.
Figure 2:
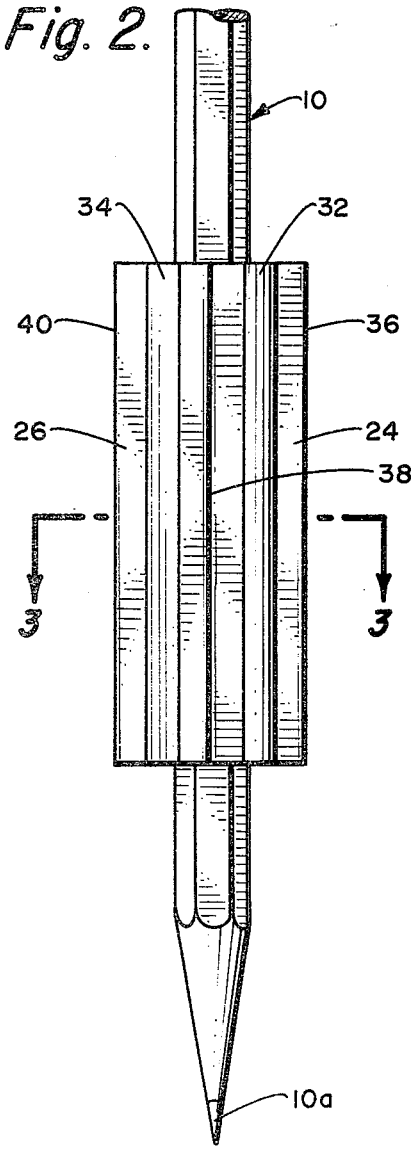
FIG. 2 is a top plan view of such finger grip.

Referring to FIG. 1, there is shown a writing device 10, such as a pencil, the lower end portion 10*a* of which comprises the usual writing means. The device 10 may be an ordinary lead pencil or mechanical pencil, or it may be a pen having its own supply of ink, if desired. As will readily be apparent to those persons skilled in the art, the present invention is adaptable to a variety of writing devices.

Positioned on the body of writing device 10 is a finger grip 12 formed of rubber, plastic, or any other suitable material which is resilient, relatively comfortable to the person's grip or touch.

Figure 3:
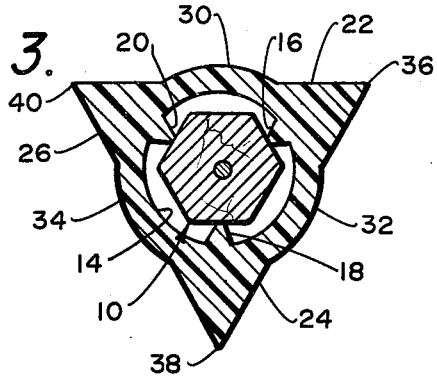
FIG. 3 is a sectional view taken substantially along line 3—3 of FIG. 2.
Figure 4:
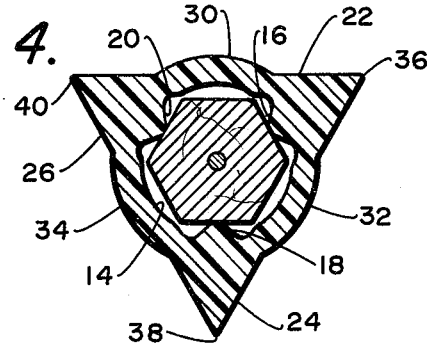
FIG. 4 is a sectional view of the finger grip similar to FIG. 3.
Figure 5:
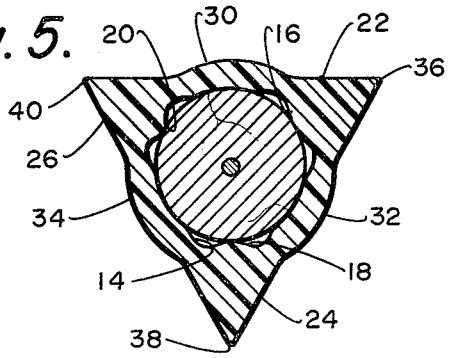
FIG. 5 is another sectional view of the finger grip similar to FIG. 3.

The gripping surfaces 22, 24 and 26 are equiangularly disposed, and are the same distance from the axis of the cylindrical opening or bore 1 resulting in a substantially triangular cross-section as shown in FIGS. 3–5. Thus, as will hereinafter appear, positioning of the grip 12 on the writing device causes the surfaces 22, 24 and 26 to be an equal distance from the device itself. This permits the device to be rotated in the writer's hand without requiring the device to be held in a new or different manner. The point of the writing device, either pencil or pen, is thus rotated causing equal wear and preventing the occurrence of flat spots.

The fact that the finger grip is formed of resilient or elastic material and has thin web portions 30, 32 and 34 in each respective planar gripping surface 22, 24 and 26 permits a given finger grip to be usable on various writing devices of different sizes as a gripping device. That is, the resilient body can expand as required for accommodating larger writing devices.

The above arrangement enables the finger grip 12 to receive the writing device 10 of the bore 14 firmly gripping the device near the writing means 10*a* thereof. The bore 14 may be provided with inwardly extending ribs or ridges 14, 16 and 18 to permit the opposite end portions of the bore to be of constant diameter. In any event, the fact that one end of the bore will readily and easily pass the writing device while the ribs 16, 18 and 20 firmly grip the same enables the finger grip 12 to be freely positioned on the writing device. That is, the ribs 16, 18 and 20 running the length of the bore 14 of the finger grip firmly secure it to the writing device. The three ribs are positioned at the thickest point of the finger grip 12 (i.e. opposite the respective apex 36, 38 and 40 of the substantially triangular slope) so that they do not limit the expansion and gripping of the web portions 30, 32 and 34.

It has been found the three equiangularly disposed gripping surfaces 22, 24 and 26 afford comfortable gripping surfaces for the thumb, index and middle fingers of a person's writing hand 42. Such surfaces are substantially flat and relatively soft to the touch due to the use of resilient plastic, rubber or other deformable material. The use of such materials also provides a comfortable and effective gripping means in the presence of moisture, such as may result from perspiration or the like. More importantly the shape promotes proper use of the writing instrument 10 as is illustrated by the hand 42 shown in FIG. 1.

When the pen or pencil is used with the finger grip 12 in the hand, as shown in FIG. 1, it is nearly impossible to grip the writing instrument improperly.

With proper gripping of the pen or pencil, fatigue is reduced and penmanship improved which can result in more effective as well as efficient communication. In addition, possible physical deficiencies due to undue stress on the hand, wrist, arm and other parts of the body can be alleviated. Since the use of the finger grip device is so important, it must be constructed in a manner which will promote its use. Thus, the gripping ribs 16, 18 and 20 and their positioning, allowing full expansion of webs 30, 32 and 34, eliminates the need for many of the finger grips 12 to accommodate many different writing instruments. One size for all not only promotes use, but greatly simplifies manufacturing efficiency and cost.

The finger grip 12 may be quickly and easily removed from the writing device merely by pulling the same so as to remove the pen or pencil from the bore 14. Just as easily, the finger grip 12 may be applied to another writing device by insertion thereof over the area normally gripped by the user. Again, frequent and continued use with the resultant benefits is promoted.

The finger grip is formed in an extrusion apparatus having a central mandrel which has an outer diameter slightly greater than the outer dimension of the intended writing instrument. The mandrel also has three grooves extending coaxially along its longitudinal axis, so that the extruded plastic is formed with a central bore having three ribs or ridges or fingers 16, 18 and 20 extending along the length thereof. These ridges firmly grip the writing instrument when it is inserted within the bore. Since the bore will, excluding said ridges, have a diameter greater than that of the writing instrument, the finger grip can be used with writing instruments of a variety of different diameters and configurations. The described ridges and the finger grip in general will be resilient enough to deform sufficiently to firmly hold the different sizes of writing instruments.

In addition to providing a finger grip, the device may be manufactured out of a rubber or plastic material which would allow it to be used as an eraser. The process of erasing the graphite from a writing instrument, such as a commonly used "lead pencil", requires the erasing material to crumble when rubbed on the paper or other writing medium. Thus, the finger grip 12 could be made of a suitable erasing rubber or plastic but in some cases the plastic material used for the eraser may need some strengthening by curing inside. By curing the inner body portion of the finger grip slightly more than the outer surface, a finger grip results which is structurally strong and has an outer surface which crumbles when rubbed against the paper, thereby serving as a very satisfactory eraser.

It is thus seen that the present invention provides gripping and erasing means for a writing device whereby such device can be used for protracted periods of time without causing fatigue or other discomforts, such as "writer's cramp". Also, such device enables the user thereof to write effectively, even in the presence of moisture or other elements which normally make the writing device slippery or sticky. The shape also prevents a pencil or other writing instrument from rolling off a desk, drafting board, or other slanted surface. In addition, such device can be used as an eraser, if desired.

Obviously, many modifications and variations of the present invention are possible in light of the above teachings. It is therefore to be understood that the full scope of the invention is not limited to the details disclosed herein and may be practiced otherwise than as specifically described.

What is claimed is:

1. A removable finger grip for writing instruments, comprising:

an elongate resilient body having a substantially triangular cross-sectional closed shape providing planar gripping surfaces;

a bore extending through the center of said body;

said bore being formed to provide thickened areas at the corners of said substantially triangular cross-sectional shape and a thin wall portion along the length of each planar gripping surface;

a plurality of inwardly extending ridges along the length of the bore at the areas coinciding with the thickened corners;

whereby said finger grip can accommodate a variety of sizes of writing instruments.

2. A removable finger grip for writing instruments according to claim 1 wherein:

said plurality of ribs comprises three ribs extending longitudinally along said bore opposite each apex of said triangular shape.

* * * * *